US006918270B2

(12) United States Patent
Yui

(10) Patent No.: US 6,918,270 B2
(45) Date of Patent: Jul. 19, 2005

(54) NECK FORMING METHOD

(75) Inventor: Manabu Yui, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 3 days.

(21) Appl. No.: 10/500,337

(22) PCT Filed: Dec. 26, 2002

(86) PCT No.: PCT/JP02/13732

§ 371 (c)(1),
(2), (4) Date: Jun. 28, 2004

(87) PCT Pub. No.: WO03/057958

PCT Pub. Date: Jul. 17, 2003

(65) Prior Publication Data

US 2005/0011231 A1 Jan. 20, 2005

(30) Foreign Application Priority Data

Dec. 28, 2001 (JP) ..... 2001-399133

(51) Int. Cl.[7] ..... D04B 7/30
(52) U.S. Cl. ..... 66/176; 66/64; 66/172 R
(58) Field of Search ..... 66/172 R, 64, 66/69, 60 R, 70, 76, 169 R, 170, 175, 176

(56) References Cited

U.S. PATENT DOCUMENTS 5,417,088 A * 5/1995 Nakai ..... 66/76
5,584,197 A * 12/1996 Okuno ..... 66/64
5,956,975 A * 9/1999 Kawashima ..... 66/64
6,138,482 A * 10/2000 Shima et al. ..... 66/69
6,550,284 B2 * 4/2003 Okamoto ..... 66/69
6,766,666 B2 * 7/2004 Okamoto ..... 66/64
6,766,667 B2 * 7/2004 Dohtsu et al. ..... 66/69
6,786,066 B2 * 9/2004 Okamoto ..... 66/172 R
6,796,149 B2 * 9/2004 Okamoto et al. ..... 66/64

FOREIGN PATENT DOCUMENTS

JP 3-75656 B2 12/1991
JP 2000-256946 A 9/2000

* cited by examiner

*Primary Examiner*—Danny Worrell
(74) *Attorney, Agent, or Firm*—Rothwell, Figg, Ernst & Manbeck, P.C.

(57) ABSTRACT

A neckline (8) is formed between right and left bodies in a first body (2) of a tubular knitted fabric comprising the first body (2) and a second body (3) by a flechage knitting. Widening is performed in the center of the neckline to form outer-layer-neck knitting loops and inner-layer-neck knitting loops. A first neck (5*b*) is formed from a whole or a part of the inner-layer-neck knitting loops in the condition that the outer-layer-neck knitting loops are held by the alternate needles on the first needle bed. Whenever a proper number of courses are knitted, the first neck is moved to overlap the loops of the first neck with the loops of the neckline so as to form loops of the next course. This step is repeatedly performed. Then, a second neck (5*a*) are formed from a whole or a part of the outer-layer-neck knitting loops. Whenever a proper number of courses are knitted, the second neck is overlapped with the loops of the neckline to form loops of the next course. This step is repeatedly performed. As a result of the steps being taken, a tubular knitwear (1) having the neck (3) whose inner layer neck (5*b*) and outer layer neck (5*a*) are overlapped in two layers is formed.

3 Claims, 5 Drawing Sheets

NECK FORMING METHOD

CROSS REFERENCE TO RELATED APPLICATION

This application is a 35 USC § 371 National Phase Entry Application from PCT/JP02/13732, filed Dec. 26, 2002, and designating the U.S.

TECHNICAL FIELD

The present invention relates to a method of forming a two-layer neck in knitwear knitted in the form of a tubular fabric with its front and back knitted fabrics continuously connected with each other at both ends thereof by using a flat knitting machine comprising at least a pair of front and back needle beds.

BACKGROUND ART

Various proposals are made for knitting knitwear on the flat knitting machine in a seamless manner, to eliminate or minimize the after-treatment effort after completion of the knitting. In general, when a sweater is knitted on the flat knitting machine, the front and back bodies are knitted in a tubular form to be continuously connected with each other at both ends thereof, while knitting from hems to shoulder. In parallel with this, right and left sleeves located at both lateral sides of the body are each knitted in a tubular form and joined to the tubular body, while they are shifted to the body. Then, after completion of the joining of the sleeves to the body, a neck is formed around a neckline opening in the body by rib knitting or the like knitting structure. Thereafter, the front body and the back body are joined together at the shoulder. This knitting method can eliminate or minimize the after-treatment effort after completion of the knitting.

The applicant of this application previously proposed in JP Laid-open (Unexamined) Patent Publication No. 2000-256946 a method of forming a neck around a neckline opening on the flat knitting machine as an example of the knitting methods that can eliminate or minimize the after-treatment effort after the completion of knitting. JP Laid-open (Unexamined) Patent Publication No. 2000-256946 discloses a knitting method using a flat knitting machine provided with needles, each comprising a needle body with a hook at a tip thereof and a slider with a tongue formed by combining two thin plates to hold a formed loop on the tongue of the slider, so as to perform the holding knitting, wherein a two-layer neck is knitted in a front body with successive needles, rather than with selected or dropped-off needles.

The application of the knitting method disclosed in JP Laid-open (Unexamined) Patent Publication No. 2000-256946 to the knitting of the front and back bodies being formed in a tubular knitted fabric requires the 1×3 knitting of forming loops with every three needles for knitting an overlapped-in-two-layer portion of the neck, or requires the flat knitting machine designed for the holding knitting technique to knit the overlapped-in-two-layer portion of the neck. When the 1×3 knitting is used, sinker loops and the needle loops are badly balanced and also the neck formed lacks of fullness and thus poorly shaped, resulting in reduction of the commercial value of the knitwear itself. Also, the holding knitting technique requires a specific flat knitting machine equipped with a special mechanism for it.

In the light of the problem above, the present invention has been made. It is an object of the present invention to provide a neck forming method that can knit a two-layer neck portion in knitwear as knitted in the form of a tubular fabric with its front and back knitted fabrics continuously connected with each other at both ends thereof, in such a manner as to eliminate the after-treatment effort, without using the 1×3 knitting that can produce the disadvantage that sinker loops and the needle loops are badly balanced and the neck lacks of fullness, as well as without proving the flat knitting machine with any special mechanism for the holding knitting technique.

DISCLOSURE OF THE INVENTION

In order to solve the problem above, the present invention provides a neck forming method of knitting a tubular knitwear on a flat knitting machine comprising a pair of first and second needle beds arranged in front and back, either of or both of which are slidably moved in a transverse direction, wherein alternate first-body knitting needles on the needle beds are used to knit a first body (e.g. a front body) and the remaining alternate second body knitting needles on the needle beds are used to knit a second body (e.g. a back body), and the first body is attached to the first needle bed (e.g. the front needle bed) and the second body is attached to the second needle bed (e.g. the back needle bed), whereby a tubular knitted fabric with its first and second bodies continuously connected with each other at both ends thereof is knitted by a half gauge knitting, starting knitting from hems to a shoulder, and an overlapped-in-two-layer neck portion where an inner layer neck and an outer layer neck are overlapped in two layers is formed in a center of a neckline in the process of the half gauge knitting, the neck forming method comprising:

(a) the step of knitting a 1-a body (e.g. a right front body) and a 1-b body (e.g. a left front body) diverging from the front body after the neckline in the front body starts knitting, and putting the loops to form the neckline into the rested state sequentially by a flechage knitting, while knitting the bodies toward the shoulder;

(b) the step of widening the loops of the first body in the center of the neckline and engaging outer-layer-neck knitting loops and inner-layer-neck knitting loops with the alternate needles, respectively, and holding either of the outer-layer-neck knitting loops and the inner-layer-neck knitting loops on second body knitting needles;

(c) the step of starting forming a first neck (e.g. a left neck) from a whole or a part of the inner-layer-neck knitting loops in the condition that the outer-layer-neck knitting loops are held by the alternate needles on the first needle bed and moving the first neck toward the 1-b body whenever a proper number of courses are knitted, to overlap the loops of the first neck at an lateral end thereof with the loops of the neckline so as to form loops of the next course, the step being repeatedly performed, and (d) the step of starting forming a second neck (e.g. a right neck) from a whole or a part of the outer-layer-neck knitting loops and moving the second neck toward the 1-a body whenever a proper number of courses are knitted, to overlap the loops of the second neck at an lateral end thereof with the loops of the neckline so as to form loops of the next course, the step being repeatedly performed.

According to the construction of the present invention, with the first body attached to the first needle bed and the second body attached to the second needle bed, the tubular knitted fabric whose first body and second body are continuously connected with each other at both ends thereof is knitted using alternate needles, starting from hems toward a shoulder. At the location where the forming of the neckline starts, the first body is separated into the 1-a body and the 1-b body to sandwich the neckline therebetween and starts knitting. The 1-a body, the second body, and the 1-b body are knitted, while the yarn feeder is inverted in traveling direction at the neckline on the 1-a body side and at the neckline on the 1-b body side. Then, at the center of the neckline in the first body, widening is carried out to engage loops to form the inner-layer-neck knitting loops and outer-layer-neck knitting loops with the alternate needles, respectively. Then, either of the inner-layer-neck knitting loops and the outer-layer-neck knitting loops are transferred to put them into engagement with the second body knitting needles. Then, the inwardly overlapped neck starts knitting from a whole or a part of the inner-layer-neck knitting loops and is moved toward the 1-b body whenever a proper number of courses of the neck are knitted, to overlap the loops of the neck at an lateral end thereof with the loops of the neckline in the 1-b body, so as to form loops of the next course. This step is repeatedly performed to form the first neck. Sequentially, the second neck starts knitting from a whole or a part of the outer-layer-neck knitting loops and is moved toward the 1-a body whenever a proper number of courses of the second neck are knitted, to overlap the loops of the second neck at an lateral end thereof with the loops of the neckline in the 1-a body so as to form loops of the next course. This step is repeatedly performed to form the second neck. After the release of the loops of the first neck and the outer-layer-neck knitting loops from the overlapping with each other, the second neck can start knitting after the first neck is knitted until the end, or the first neck and the second neck can both be knitted in parallel. After the knitting of the first and second necks is completed until the end, the loops of the final courses of the 1-a body and 1-b body and the loops of the final course of the second body are overlapped with each other to join together the first and second bodies and then bound off by the binding-off process or the like to prevent loosening of the stitches, to complete the knitting of the knitwear.

The neck forming method of the invention is characterized in that in the step (a), the flechage knitting is carried out to form a V-shaped neckline taking the center of the front body as a boundary; in the step (c), the first neck (e.g. the left neck) is knitted from the inner-layer-neck knitting loops located in the 1-a body (e.g. the right front body); and in the step (d), the second neck (e.g. the right neck) is knitted from the outer-layer-neck knitting loops located in the 1-b body (e.g. the left front body).

This construction of the invention can form a well-shaped neck having a V-shaped bottom where the first and second necks are overlapped with each other.

Also, the present invention is also characterized in that the first neck and the second neck are formed with a rib knitting structure. This construction of the present invention can form the neck having good shape retention and good appearance

BEST MODE FOR CARRYING OUT THE INVENTION

Figure 1:
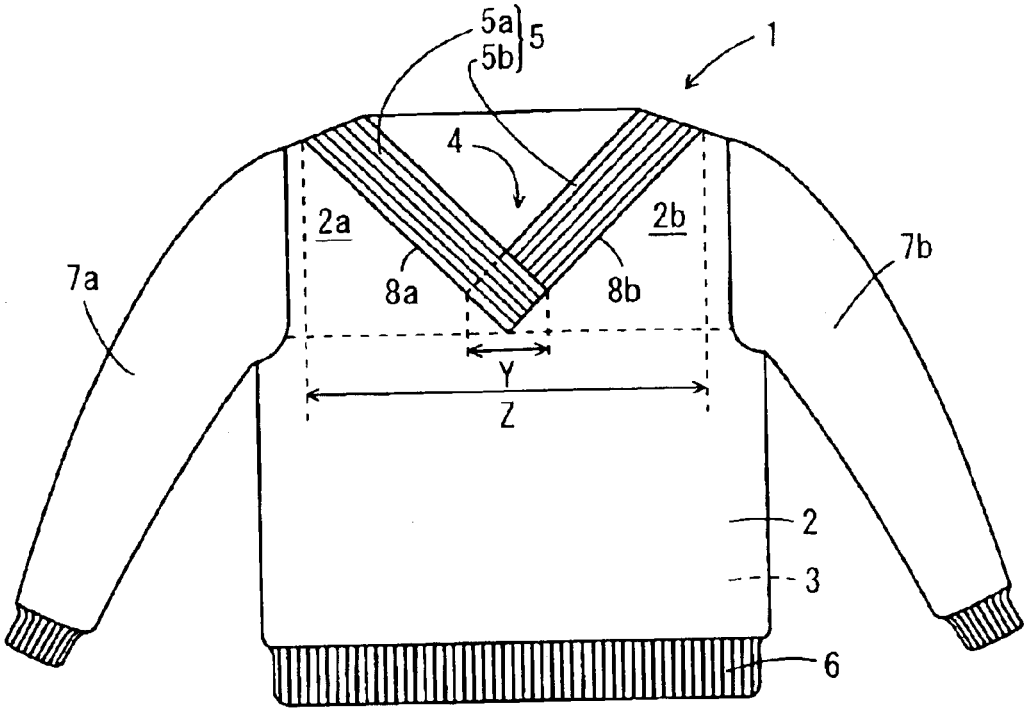
FIG. 1 is an illustration showing a sweater having a neck formed by the knitting method of the invention.

A certain preferred embodiment of the present invention will be described in detail with reference to the accompanying drawings. In the embodiment described below, a two-bed flat knitting machine comprising a pair of front and back needle beds, the back needle bed of which can be racked transversely relative to the front needle bed, is used for the knitting of the invention. FIG. 1 illustrates a sweater 1 knitted by the method of the embodiment of the invention. The sweater 1 has a body comprising front and back bodies 2, 3 continuously connected with each other at both ends thereof, and right and left sleeves 7*a*, 7*b* connected to the body from sides to a shoulder. The front body 2 has a neck formed along a neckline opening 4, and the neck has a two-overlapped neck portion formed at a center of the front body 2. A neck 5*a* on the right side (hereinafter it is called the right neck 5*a*) formed along a right neckline 8*a* of a right front body 2*a* is knitted starting at the right side with respect to the center of the front body 2. A neck 5*b* on the left side (hereinafter it is called the left neck 5*b*) formed along a left neckline 8*b* of a left front body 2*b* is knitted starting at the left side with respect to the center of the front body 2. The loops of the final courses of the right neck 5*a* and left neck 5*b* are overlapped with the loops of the final course of the back body 3 and then bound off by a known binding-off process.

In the following, the knitting of forming the two-overlapped neck portion in the sweater 1 will be described. It is to be noted that an even fewer number of needles than the actual number of needles is illustrated for explanatory convenience. As the method of knitting the front and back bodies 2, 3 and the right and left sleeves 7*a*, 7*b* into a tubular body starting at the hems 6 and at the cuffs, respectively, and then joining to each other from the sides to the shoulder is already known, the description of the embodiment is limited to the knitting after the start of forming the neckline opening 4. Although after the start of forming the necks 5*a*, 5*b*, the forming of the necks 5*a*, 5*b* and the joining of the sleeves 7*a*, 7*b* to the bodies 2, 3 are carried out concurrently, the description on the knitting of joining the sleeves 7*a*, 7*b* and the front and back bodies 2, 3 is omitted for the same reason.

The course 1 of FIG. 1 illustrates the state at the point when the knitting to be completed before the start of knitting the neckline 8 is completed. Alternate needles on the needle bed (e.g. odd-numbered needles from the left end of the needle bed) are used to knit the front body 2 or the first body of the knitwear, and the remaining alternative needles (e.g. even-numbered needles from the left end of the needle bed) are used to knit the back body 3 or the second body of the knitwear. The front body 2 is attached to the front needle bed and the back body 3 is attached to the back needle bed, for the half-gauge knitting. In the half-gauge knitting, for example when the back body 3 is knitted, the back body 3 is knitted in the state in which the loops of the front body 2 are all held by the needles of the front needle bed. The front body 2 as is in this state is expressed here as being attached to the front needle bed. On the other hand, when the front body 2 is knitted, the front body 2 is knitted in the state in which the loops of the back body 2 are all held by the needles of the back needle bed. The back body 3 as is in this state is expressed here as being attached to the back needle bed. As the half gauge knitting is already disclosed in JP Patent Publication No. Hei 3-75656 as previously filed by the same applicant, any further description thereon is omitted.

Figure 2:
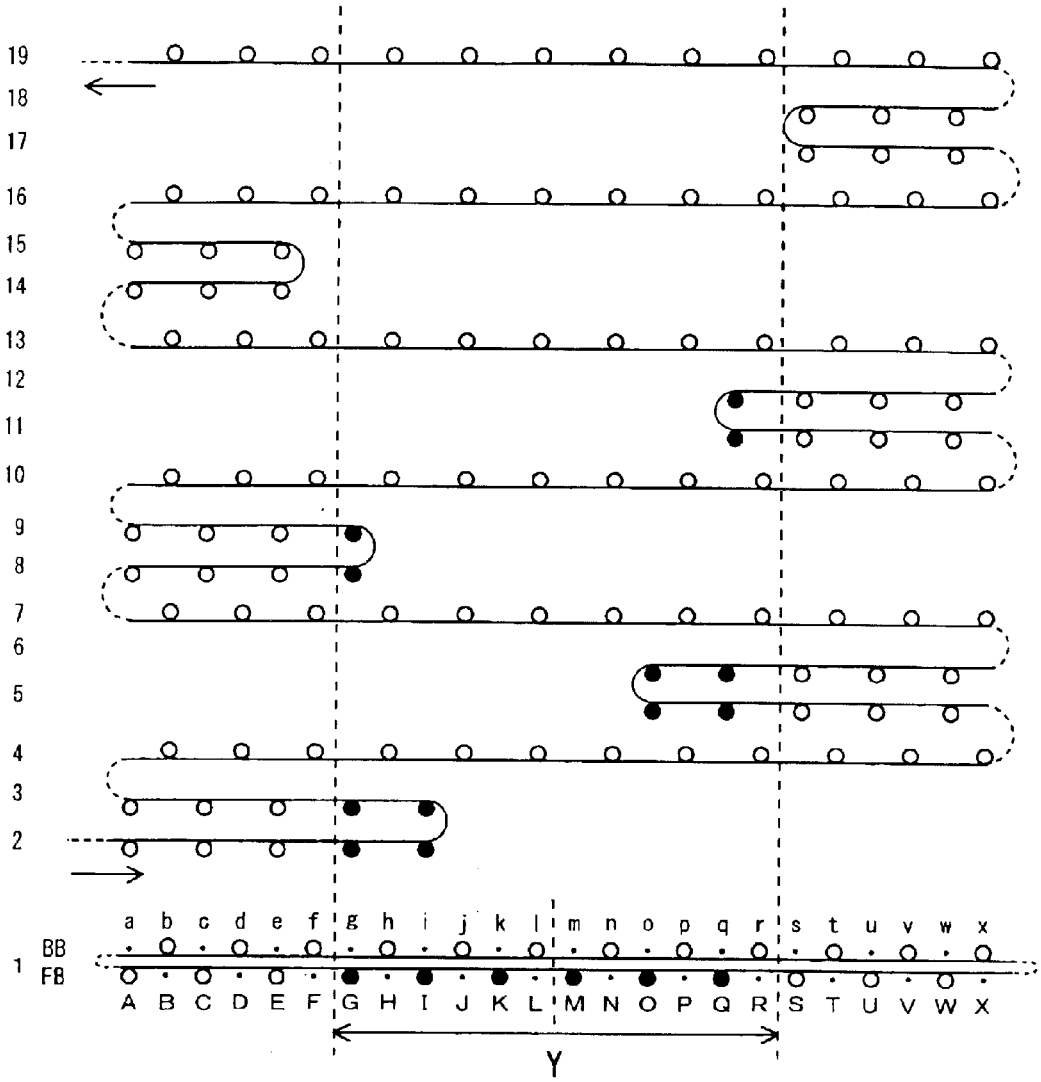
FIG. 2 is a knitting courses diagram illustrating the invention.

In the course 1 of FIG. 2, only the loops of the necks 5*a*, 5*b* in the center of the neckline 8 formed in the front and back bodies 2, 3 are shown. The remaining portions of the bodies 2, 3 and right and left sleeves 7*a*, 7*b* are knitted in the regions on the outer side of the region illustrated in the course 1. The loops depicted by black circles in the course 1 are those in the region from which the knitting of the overlapped-in-two-layer portion of the neck 5*a*, 5*b* is started, and the region corresponds to the region indicated by Y in FIG. 1. The knitting to form the overlapped-in-two-layer portion of the neck 5*a*, 5*b* is started from the course 2. In the courses 2–19 of FIG. 2, the right front body 2*a* and the left front body 2*b* are knitted by the flechage knitting to form the neckline 8 before the necks 5*a*, 5*b* are formed. In the courses 2 and 3, the left front body 2*b* is knitted by the flechage knitting, during which the needle K of the front needle bed FB holding the loop at the lateral end of the right front body 2*a* is kept in its rest state until the forming of the necks 5*a*, 5*b* is started. In the next course 4, the back body 3 is knitted. In the courses 5 and 6, the left front body 2*b* is knitted by the flechage knitting, during which the needle M of the front needle bed holding the loop at the lateral end of the left front body 2*b* is kept in its rest state.

In the course 7, the back body 3 is knitted again. In the remaining courses from the course 8, while the knitting of the courses 2–7 is repeated, the needles in the region corresponding to the neckline 8 are put in the rest state sequentially, to form the V-shaped neckline 8. In this embodiment, reference is made to the knitting wherein the forming of the necks 5*a*, 5*b* is not started until after completion of the knitting of the right front body 2*a* and left front body 2*b* up to their final courses to join them to the back body 3. The right and left front bodies 2*a*, 2*b* and the sleeves 7*a*, 7*b* need not necessarily be knitted up to the final courses before the start of forming of the necks 5*a*, 5*b*. Another knitting may also be taken wherein the knitting of the right and left front bodies 2*a*, 2*b* and the sleeves 7*a*, 7*b* is interrupted, the forming of the necks 5*a*, 5*b* is started, and then the necks 5*a*, 5*b*, the bodies 2, 3 and the sleeves 7*a*, 7*b* are knitted in parallel.

Figure 3:
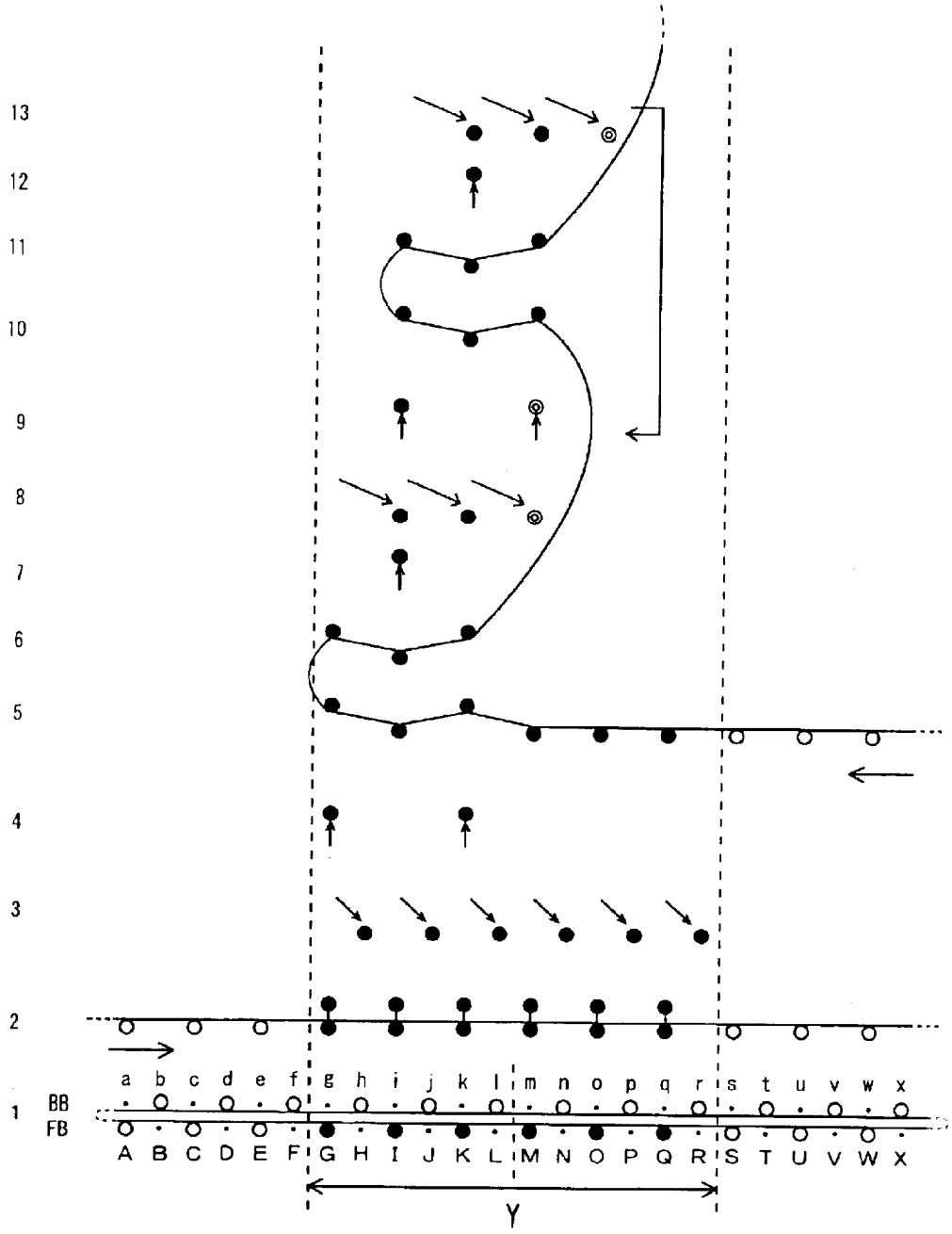
FIG. 3 is a knitting courses diagram illustrating the invention.
Figure 4:
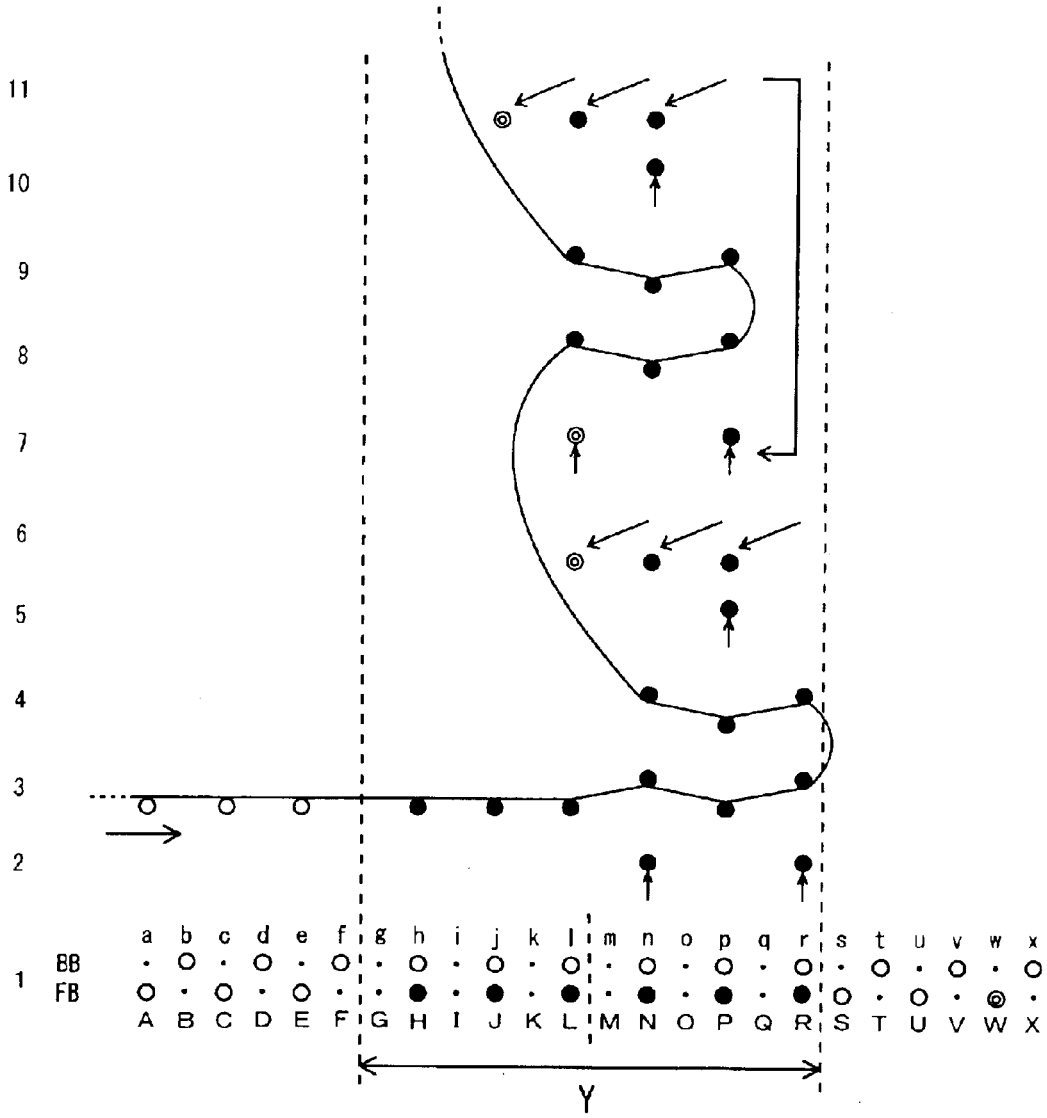
FIG. 4 is a knitting courses diagram illustrating the invention.

In the case where the forming of the necks 5*a*, 5*b* is not started until after the right and left front bodies 2*a*, 2*b* are knitted until the end, as mentioned above, the loops in the region Z are put in the rest state for the flechage knitting. With reference to FIGS. 3 and 4, description is given on the forming of the necks 5*a*, 5*b*. The course 1 of FIG. 3 shows the state in which all the loops in the flechage knitting region Z are knitted up. The loops as were put in the rest state for the flechage knitting are held on the front needle bed, and the loops of the final course of the back body 3 are held on the back needle bed. In the course 2, a yarn is fed to the needles holding thereon the loops in the region Z and put in the rest state, then starting knitting to form the necks 5*a*, 5*b* in the region Y. In the course 2, the yarn is fed to the loops of the neckline 8. Also, the needles G, I, K, M, O, Q of the front needle bed FB are shifted up to the transference positions in the region Y where the forming of the necks 5*a*, 5*b* is started, pushing loop opening members into the loops to spread the loops. In addition, the needles g, i, k, m, o, q of the back needle bed BB are shifted up, moving their hooks into the loops held by the needles G, I, K, M, O, Q of the front needle bed FB. Simultaneously, the yarn is fed to the needles G, I, K, M, O, Q of the front needle bed FB, passing under the loops to be transferred to the needles g, I, k, m, o, q of the back needle bed, to form loops in the split knit. In the course 3, the loops as transferred to the back needle bed in the course 2 are transferred back to the needles H, J, L, N, P, R of the front needle bed as used to form the back body 3, before the forming of the necks 5*a*, 5*b* is started. In the following description, the loops held by the needles G, I, K, M, O, Q of the front needle bed in the course 2 are expressed as the inner-layer-neck knitting loops (left neck 5*b*), and the loops held by the needles g, i, k, m, o, q of the back needle bed are expressed as the outer-layer-neck knitting loops (right neck 5*a*). However, selection of the inner-layer-neck knitting loops or the outer-layer-neck knitting loops from the loops formed by the split knit in the course 2 and held on the front needle bed and the back needle bed can be made arbitrarily.

In the course 4, the loops in wales to be formed as back stitches of rib knitting are previously transferred to the back needle bed before the knitting of the left neck 5*b*. In the course 5, the yarn is fed to the left front body 2*b* leftwards to knit the left neck 5*b* by the rib knitting using the inner-layer-neck knitting loops in three wales in the right front body. At this time, the outer-layer-neck knitting loops (right neck 5*a*) are all held on the back body knitting needles on the front needle bed. In the course 6, the left neck 5*b* is formed in the same manner as in the course 5. In the course 7, the loop in the needle 1 of the front needle bed is transferred to the back needle bed. Thereafter, the loops of the left neck 5*b* are racked rightwards two pitches, respectively, and transferred to the front needle bed. At this time, the loop transferred is overlapped with the loop of the neckline 8*a* of the left front body 2*a* at the needle M of the front needle bed as was put in the rest state during the flechage knitting. In the course 9, the loops in wales to be formed as back stitches are transferred to the back needle bed. In the courses 10 and 11, the left neck 5*b* is knitted by the rib knitting. In the course 12, the loop in the needle K is transferred to the back needle bed, and in the course 13, the loops of the left neck 5*b* are racked rightwards two pitches, respectively, and transferred to the front needle bed. The knitting shown in the courses 9–13 above is repeatedly performed to form the left neck 5*b* along the neckline 8*b* of the left front body 2*b*. The loops of the left front body 2*b* to be overlapped with the loops of the left neck 5*b* at the lateral end are loops of the neckline 8*b* of the left body 2*b* including the left neck knitting loops located in the region where the split stitch (widening) was performed. After this, the yarn is fed from right to left to the back body 3 held by the needles of the back needle bed by the knitting, not shown, and then the yarn feeder is moved leftwards before the knitting of the right neck 5*a*.

Next, the knitting of the right neck 5*a* will be described with reference to FIG. 4. In the course 1, the loops as transferred in the course 3 of FIG. 3 are held by the needles H, J, L, N, P, R of the front needle bed. In the course 2, after the back needle bed is racked leftwards one pitch, the loops in wales to be formed as the back stitches of the right neck 5*a* are transferred to empty needles of the back needle bed. In the course 3, the yarn is fed rightwards from the yarn feeder as previously moved leftwards before the knitting of the right front body 2*a*, and the right front body 2*a* and the right neck 5*a* are knitted. In the course 4, the right neck 5*a* is knitting by rib knitting. In the course 5, the loop in the needle P is transferred to the back needle bed. In the course 6, the right neck 5*a* is racked leftwards two pitches and transferred to the front needle bed, so that the loop of the right neck 5*a* at the left end is overlapped with the loop of the neckline 8*a* of the right front body 2*a*. In the course 7, the loops in wales to be formed as back stitches of rib knitting are transferred to the back needle bed. In the courses 10 and 11, the left neck 5*b* is knitted by the rib knitting. In the courses 8 and 9, the right neck 5*a* is knitted in rib knitting feeding the yarn to the right neck 5*a*. In the course 10, the loop in the needle N is transferred to the back needle bed. In the course 11, the loops of the right neck 5*a* are racked leftwards two pitches and transferred to the front needle bed, so that the loop of the right neck 5*a* at the left end is overlapped with the loop of the neckline 8*a*. After this, the same knitting as in the knitting in the courses 7–11 is repeatedly performed to form the right neck 5*a* along the neckline 8*a* of the right front body 2*a*. The loops of the right front body 2*a* to be overlapped with the loops of the right neck 5*a* at the lateral end are loops of the neckline 8*a* of the right body 2*a* including the right neck knitting loops located in the region where the split stitch (widening) was performed. The loops of the final course of the right neck 5*a* are overlapped with the loops of the back body 3 and bound off by the binding-off or the like to prevent loosening of the stitches to complete the forming of the neck. The neck forming method mentioned above can allow the forming of an overlapped-in-two-layer portion of the right and left necks 5*a*, 5*b* in the center of the front body 2.

In the embodiment mentioned above, the forming of the necks 5*a*, 5*b* is not started until after completion of the knitting of the right front body 2*a* and left front body 2*b* up to their final courses. This knitting is not limitative. An alternative knitting may be adopted such as, for example, the knitting technique that after the knitting of the right and left front bodies 2*a*, 2*b* is knitted partway by the flechage knitting, the necks 5*a*, 5*b*, the front bodies 2*a*, 2*b*, and the sleeves 7*a*, 7*b* are formed in parallel with each other. In the knitting method of the embodiment of the invention, when the overlapped-in-two-layer portion of the right and left necks 5*a*, 5*b* is formed, one of the necks (left neck 5*b*) is knitted successively until the loops at the left end of the left neck 5*b* are moved to the left side with respect to the loop at the right end of the right neck 5*a*, so the left neck is knitted up until the position where the left neck 5*b* does not hinder the transference of the right neck 5*a* when moved leftwards. Thereafter, the knitting of the other of the necks (right neck 5*a*) is started. Hence, this knitting technique enables the necks 5*a*, 5*b* to be knitted in the state in which three parts of the knitted fabrics are overlapped in three layers. Also, since the knitting method of the embodiment of the invention can keep the empty needles used for the rib knitting, the necks 5*a*, 5*b* can be formed with the rib knitting structure.

Figure 5:
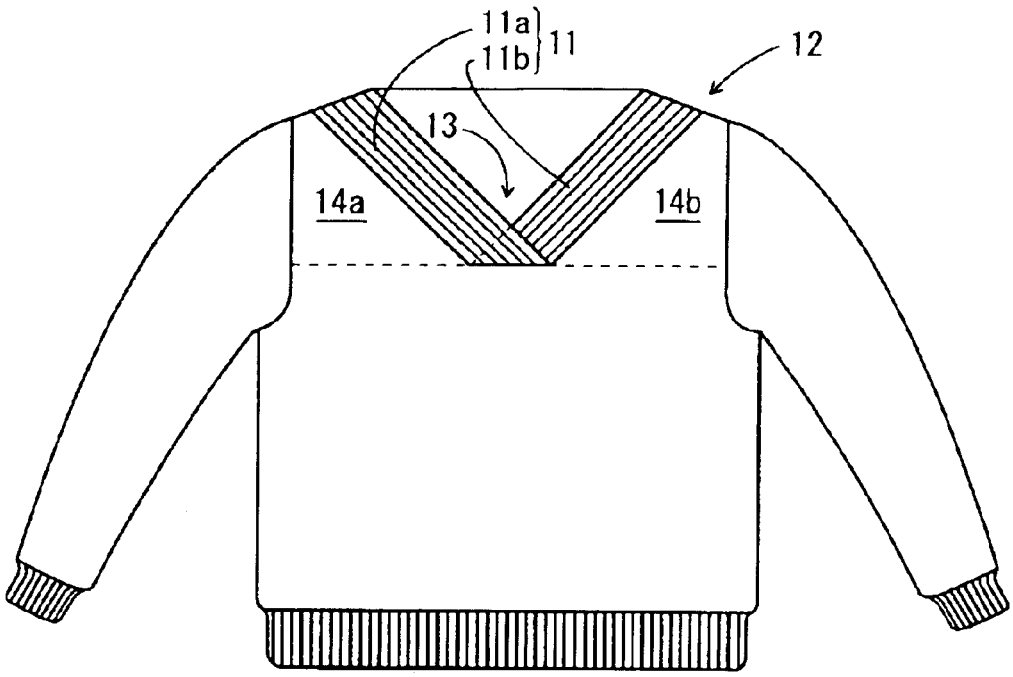
FIG. 5 is an illustration showing a sweater having a neck formed by the knitting method of another embodiment of the invention.

Although the neck comprising the right and left necks 5*a*, 5*b* formed to have a V-shaped bottom portion where the right and left necks 5*a*, 5*b* are crossed each other has been described above, the neck 11 is formed to have a flattened bottom at the bottom where a right neck 11*a* and a left neck 11*b* are crossed each other, as shown in FIG. 5. In a sweater 12 shown in FIG. 5, a right front body 14*a* and a left front body 14*b* are knitted by the flechage knitting, while the loops in the region located in the center of the neckline 13 are put in the rested state. Then, after completion of the flechage knitting, the widening is performed for the loops in the rested region, then starting knitting of the inner layer neck portion or the left neck 11*b* from all the inner-layer-neck knitting loops as widened and also starting knitting of the outer layer neck portion or the right neck 11*a* from all the outer-layer-neck knitting loops in the same manner.

Although the embodiment of the knitting using the two-bed flat knitting machine comprising a pair of front and back needle beds has been described above, the knitting method of the invention can also be practiced by using a three-bed or four-bed flat knitting machine having an upper auxiliary needle bed(s) placed over the pair of front and back needle beds. Also, although the embodiment wherein the new loops are formed by widening at the location at which the forming of the neck 5*a*, 5*b* starts has been described above, the alternative may be adopted such as, for example, forming the loops by empty knitting. Also, the neck can be knitted to have the other knitting structure than the 1×1 rib knitting.

INDUSTRIAL APPLICABILITY

As mentioned above, the neck forming method of the present invention can bring the forming of the neck of a specific form into a finishing state requiring no after-treatment, for which some after-treatment was required hitherto after completion of the knitting on the flat knitting machine, by using a common flat knitting machine with no special mechanism, such as the holding mechanism. Also, the 1×3 knitting to form loops with every three needles is not needed for knitting an overlapped-in-three-layer portion where the back body and the two-layer neck are overlapped with each other and accordingly the sinker loops and the needle loops can be kept from being badly balanced. Hence, the knitwear product having the neck rich in fullness and solidness of high commercial value can be produced.

What is claimed is:

1. A neck forming method of knitting a tubular knitwear on a flat knitting machine comprising a pair of first and second needle beds arranged in front and back, either of or both of which are slidably moved in a transverse direction, wherein alternate first-body knitting needles on the needle beds are used to knit a first body (e.g. a front body) and the remaining alternate second-body knitting needles on the needle beds are used to knit a second body (e.g. a back body), and the first body is attached to the first needle bed (e.g. the front needle bed) and the second body is attached to the second needle bed (e.g. the back needle bed), whereby a tubular knitted fabric with its first and second bodies continuously connected with each other at both ends thereof is knitted by a half gauge knitting, starting knitting from hems to a shoulder, and an overlapped-in-two-layer neck portion where an inner layer neck and an outer layer neck are overlapped in two layers is formed in a center of a neckline in the process of the half gauge knitting, the neck forming method comprising:

(a) the step of knitting a 1-a body (e.g. a right front body) and a 1-b body (e.g. a left front body) diverging from the front body after the neckline in the front body starts knitting, and putting the loops to form the neckline into the rested state sequentially by a flechage knitting, while knitting the bodies toward the shoulder;

(b) the step of widening the loops of the first body in the center of the neckline and engaging outer-layer-neck knitting loops and inner-layer-neck knitting loops with the alternate needles, respectively, and holding either of the outer-layer-neck knitting loops and the inner-layer-neck knitting loops on second body knitting needles;

(c) the step of starting forming a first neck (e.g. a left neck) from a whole or a part of the inner-layer-neck knitting loops in the condition that the outer-layer-neck knitting loops are held by the alternate needles on the first needle bed and moving the first neck toward the 1-b body whenever a proper number of courses are knitted, to overlap the loops of the first neck at an lateral end thereof with the loops of the neckline so as to form loops of the next course, the step being repeatedly performed, and (d) the step of starting forming a second neck (e.g. a right neck) from a whole or a part of the outer-layer-neck knitting loops and moving the second neck toward the 1-a body whenever a proper number of courses are knitted, to overlap the loops of the second neck at an lateral end thereof with the loops of the neckline so as to form loops of the next course, the step being repeatedly performed.

2. The neck forming method according to claim 1, wherein in the step (a) of claim 1, the flechage knitting is carried out to form a V-shaped neckline taking the center of the front body as a boundary; in the step (c), the first neck (e.g. the left neck) is knitted from the inner-layer-neck knitting loops located in the 1-a body (e.g. the right front body); and in the step (d), the second neck (e.g. the right neck) is knitted from the outer-layer-neck knitting loops located in the 1-b body (e.g. the left front body).

3. The neck forming method according to claim 1, wherein the first neck and the second neck are formed with a rib knitting structure.

* * * * *